US009022061B2

(12) United States Patent
Kim et al.

(10) Patent No.: US 9,022,061 B2
(45) Date of Patent: May 5, 2015

(54) DISPLACEMENT CONTROL VALVE FOR VARIABLE DISPLACEMENT COMPRESSOR

(75) Inventors: Hak Soo Kim, Daejeon-shi (KR); Young Il Chang, Ansan-si (KR); Yong Ju Lee, Suwon-si (KR); Ki Jung An, Seoul (KR); Geon Ho Lee, Seongnam-si (KR)

(73) Assignees: Doowon Technical College, Anseong-shi, Kyonggi-do (KR); Doowon Electronic Co., Ltd., Asan-shi, Chungnam (KR)

( * ) Notice: Subject to any disclaimer, the term of this patent is extended or adjusted under 35 U.S.C. 154(b) by 1034 days.

(21) Appl. No.: 13/123,492

(22) PCT Filed: Sep. 29, 2009

(86) PCT No.: PCT/KR2009/005564
§ 371 (c)(1),
(2), (4) Date: May 6, 2011

(87) PCT Pub. No.: WO2010/041841
PCT Pub. Date: Apr. 15, 2010

(65) Prior Publication Data

US 2011/0220825 A1 Sep. 15, 2011

(30) Foreign Application Priority Data

Oct. 9, 2008 (KR) ..... 10-2008-0099254

(51) Int. Cl.
*F16K 17/38* (2006.01)
*F04B 27/18* (2006.01)

(52) U.S. Cl.
CPC ..... *F04B 27/1804* (2013.01); *F04B 2027/1813* (2013.01); *F04B 2027/1827* (2013.01)

(58) Field of Classification Search
USPC ..... 137/468, 538; 62/209, 229, 228.3; 251/129.15
See application file for complete search history.

(56) References Cited

U.S. PATENT DOCUMENTS 4,905,477 A * 3/1990 Kazuhiko ..... 62/196.3
6,385,982 B1 * 5/2002 Ota et al. ..... 62/209

(Continued)

FOREIGN PATENT DOCUMENTS

JP 2000-009247 A 1/2000
JP 2001-140767 A 5/2001
JP 2001-207959 A 8/2001

(Continued)

OTHER PUBLICATIONS

International Search Report dated Apr. 26, 2010 of PCT/KR2009/005564. (4 pages).

*Primary Examiner* — Kevin Lee
*Assistant Examiner* — P. Macade Nichols
(74) *Attorney, Agent, or Firm* — Knobbe Martens Olson & Bear, LLP.

(57) ABSTRACT

The invention provides a displacement control valve for a variable displacement compressor comprising: a valve housing having a discharge chamber connecting space and a crank chamber connecting space; an electronic solenoid; and a valve body configured to reciprocate within the valve housing the electronic solenoid. The displacement control valve is opened and closed when the valve body moves from the discharge chamber connecting space toward the crank chamber connecting space, making it possible to enlarge a cross-sectional area of the valve body and improving productivity.

10 Claims, 9 Drawing Sheets

(56) References Cited

U.S. PATENT DOCUMENTS

| | | | | |
|---|---|---|---|---|
| 6,443,708 | B1 | 9/2002 | Hirota | |
| 6,589,020 | B2 * | 7/2003 | Kimura et al. | 417/222.2 |

FOREIGN PATENT DOCUMENTS

| | | | |
|---|---|---|---|
| JP | 2006-002644 | A | 1/2006 |
| JP | 2008-157031 | A | 7/2008 |

* cited by examiner

DISPLACEMENT CONTROL VALVE FOR VARIABLE DISPLACEMENT COMPRESSOR

TECHNICAL FIELD

The present invention relates to a displacement control valve for a variable displacement compressor, and more particularly to a displacement control valve for a variable displacement compressor which has a valve seat surface at a location different from that of a conventional one, thus enhancing productivity, and prevents a discharge temperature from increasing excessively, thus improving safety.

BACKGROUND ART

Since a compressor provided in a cooling system of a vehicle air conditioning apparatus is directly connected to an engine through a belt, its RPM cannot be controlled.

Thus, in recent years, variable displacement compressors are widely used to vary an amount of discharged refrigerant to achieve a cooling capacity without being restricted by the RPM of an engine.

A variety of types of variable displacement compressors such as a swash plate compressor, a rotary compressor, and a scroll compressor are currently disclosed.

A swash plate compressor is configured such that a swash plate installed within a crank chamber rotates while its rotary shaft is rotating and a piston reciprocates during rotation of the swash plate, in which case an inclined angle of the swash plate is varied. Then, a refrigerant in a suction chamber is suctioned into a cylinder, compressed, and discharged into a discharge chamber during reciprocation of the piston such that an inclined angle of the swash plate can be varied according to a difference between a pressure in the crank chamber and a pressure in the suction chamber, making it possible to regulate an amount of discharged refrigerant.

In particular, an electronic solenoid type displacement control valve is employed to be opened and close to adjust a pressure in a crank chamber using flowing currents and thus adjust an inclined angle of a swash plate to regulate a displacement of discharged refrigerant.

Then, during an operation of a capacity control valve, signals for a detected RPM of an engine, interior and exterior temperatures of a vehicle, and a temperature of an evaporator are processed by a control unit equipped with a CPU, and currents are sent to an electronic coil of a displacement control valve based on the processing result.

A general example of a displacement control valve for a variable displacement compressor is disclosed in U.S. Pat. No. 6,443,708 (hereinafter, referred to as "conventional technology"). Hereinafter, a configuration of the conventional displacement control valve for a variable displacement compressor will be schematically described with reference to FIG. 1.

As shown, the conventional displacement control valve 20 for a variable displacement compressor includes a valve housing 40, a valve body 30, and an electronic solenoid such that the valve body 30 reciprocates to open and close a discharge chamber connecting hole 6 formed in a valve housing 40 as currents flow through the electronic solenoid.

A suction chamber connecting hole 8, a crank chamber connecting hole 5, and a discharge chamber connecting hole 6 are formed in the valve housing 40 to receive pressures in a suction chamber, a crank chamber, and a discharge chamber respectively. The discharge chamber connecting hole 6 and the crank chamber connecting hole 5 are communicated with each other.

The valve body 30 is configured to reciprocate as currents flow through the electronic solenoid to open and close the discharge chamber connecting hole 6 when it passes through the crank chamber connecting hole 5 while reciprocating. A spring 28 is installed at a lower portion of the valve body 30 to lower the valve body 30 in a normal state where there is no external force and thus open the discharge chamber connecting hole 6.

The electronic solenoid includes a movable rod 24 connected to the valve body 30, and an electronic coil 21 disposed at a circumference of the movable rod 24. A movable core 23 is installed at an end of the movable rod 24.

However, according to the conventional technology, since the valve body 30 is configured to be closed when it goes from the crank chamber connecting hole 5 to which a crank chamber pressure Pc is applied toward the crank chamber connecting hole 6 to which a discharge chamber pressure Pd is applied, the area of the discharge connecting hole 5 is too large in a valve where a pressure difference Pd−Ps is used as a parameter for an opening degree of the valve, causing the valve body 30 to be slim.

That is, since a pressure Pd is applied to a cross-sectional area of the valve body 30, if the area where the pressure Pd is applied is too large, a valve opening force applied to the valve body 30 becomes excessive, causing a current applied to the electronic solenoid to close the valve body 30 to increase and an amount of generated heat to become larger.

Accordingly, the productivity of the displacement control valve 20 is severely lowered.

DISCLOSURE

Technical Problem

Therefore, the present invention has been made in view of the above-mentioned problems, and the present invention provides a displacement control valve of a variable displacement compressor wherein a position of the seat surface is changed such that the seat surface is closed as the valve body goes from the discharge chamber connecting space toward the crank chamber connecting space, making it possible to enlarge a cross-sectional area of the valve body and improving productivity.

According to the present invention, a valve can be compulsorily opened when a discharge temperature is excessively high, avoiding damage to the peripheral structure of a compressor.

The present invention also provides a displacement control valve of a variable displacement compressor which avoids damage to a compressor due to an excessive discharge temperature.

Technical Solution

In accordance with an aspect of the present invention, there is provided a displacement control valve for a variable displacement compressor comprising: a valve housing having a discharge chamber connecting space and a crank chamber connecting space; an electronic solenoid; and a valve body configured to reciprocate within the valve housing the electronic solenoid such that the displacement control valve is opened or closed when the valve body moves from the crank chamber connecting space to the discharge chamber connecting space or from the discharge chamber connecting space to the crank chamber connecting space A first guide hole connecting the discharge chamber connecting space and the crank chamber connecting space passes through the interior of the valve housing, wherein the valve body is divided into a large diameter portion and a small diameter portion with respect to a step configured to open and close an inlet of the first guide hole, wherein the valve body is supported by an off-spring, and wherein a suction pressure is applied to a tip end of the valve body opposite to the electronic solenoid and a crank chamber pressure is applied to an end of the valve body on the side of the electronic solenoid.

A first guide hole connecting the discharge chamber connecting space and the crank chamber connecting space passes through the interior of the valve housing, wherein the valve body is divided into a large diameter portion and a small diameter portion with respect to a step configured to open and close an inlet of the first guide hole, wherein the valve body is supported by an off-spring, and wherein a suction pressure is applied to a tip end of the valve body opposite to the electronic solenoid and an end of the valve body on the side of the electronic solenoid respectively.

A first guide hole connecting the discharge chamber connecting space and the crank chamber connecting space passes through the interior of the valve housing, wherein the valve body is divided into a large diameter portion and a small diameter portion with respect to a step configured to open and close an inlet of the first guide hole, wherein the valve body is supported by an off-spring, wherein a suction pressure is applied to a tip end of the valve body opposite to the electronic solenoid and an end of the valve body on the side of the electronic solenoid respectively, and wherein a bellows is installed at a tip end of the valve body opposite to the electronic solenoid.

A connecting passage is formed between the tip end of the valve body opposite to the electronic solenoid to which the suction pressure is applied and the end of the valve body on the side of the electronic solenoid.

A pressure portion to which the suction pressure at the tip end of the valve body opposite to the electronic solenoid and the crank chamber pressure are simultaneously applied is installed at the small diameter portion of the valve body, and wherein a cross-sectional area of a portion, out of the pressure portion, to which the crank chamber pressure is applied is the same as a cross-sectional area of the large diameter portion of the valve body.

The pressure portion is detachably installed in the valve body.

A thermally deformed means for being deformed by a discharge temperature to move the valve body is installed in the discharge chamber connecting space of the valve housing.

Meanwhile, there is provided a displacement control valve for a variable displacement compressor comprising: a valve housing having a discharge chamber connecting space and a crank chamber connecting space;

an electronic solenoid; and a valve body configured to reciprocate within the valve housing the electronic solenoid, wherein a thermally deformed means for being deformed by a discharge temperature to move the valve body is installed in the discharge chamber connecting space of the valve housing.

The thermally deformed means may be a bimetal.

BRIEF DESCRIPTION OF THE DRAWINGS

The foregoing and other objects, features and advantages of the present invention will become more apparent from the following detailed description when taken in conjunction with the accompanying drawings in which.

BEST MODE

Mode for Invention

Hereinafter, exemplary embodiments of the present invention will be described with reference to FIGS. 2 to 8.

First, a structure of a variable displacement swash compressor in which a displacement control valve is installed according to the present invention will be schematically described with reference to FIG. 2.

Figure 1:
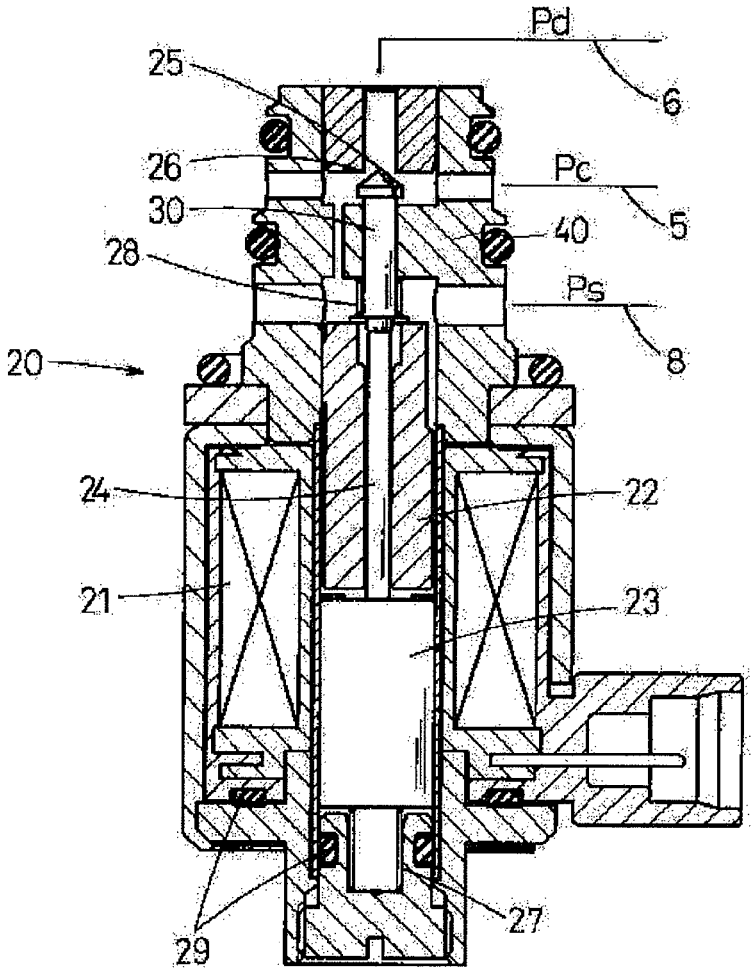
FIG. 1 is a longitudinal sectional view illustrating a structure of a conventional displacement control valve.
Figure 2:
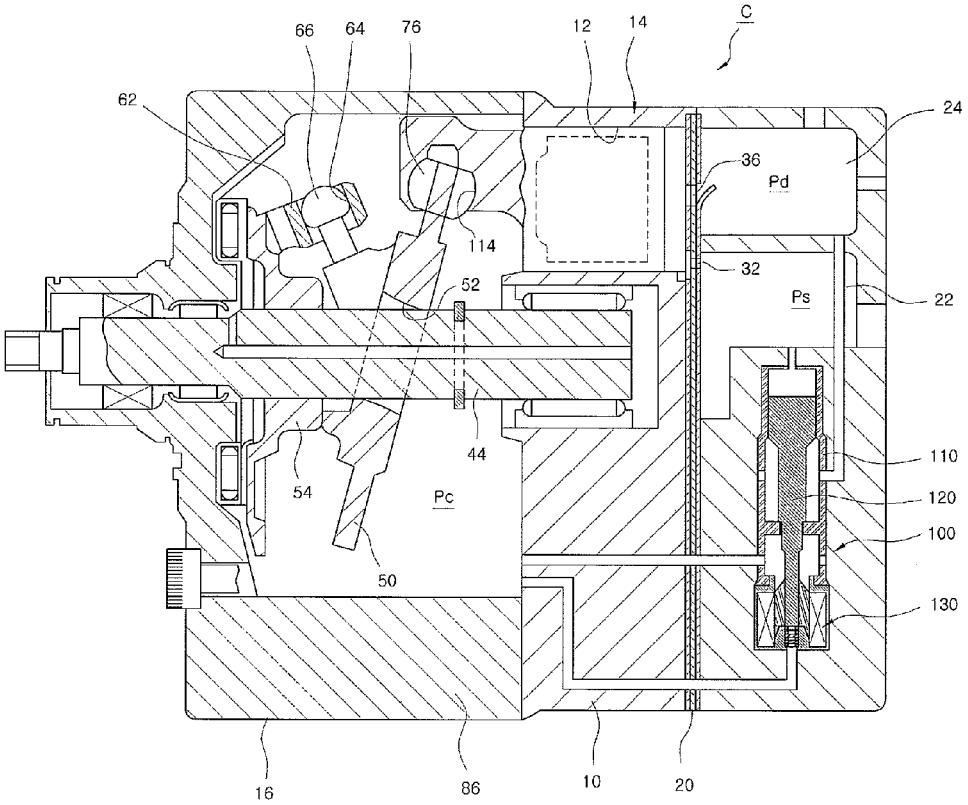
FIG. 2 is a longitudinal sectional view illustrating an example of a variable displacement compressor according to the present invention.

As illustrated in FIG. 2, the variable displacement swash compressor C includes a cylinder block 10 having a plurality of cylinder bores 12 formed on an inner peripheral surface thereof along a lengthwise direction thereof in parallel to each other, a front housing 16 sealingly coupled to a front side of the cylinder block 10, and a front housing 18 sealingly coupled to a rear side of the cylinder block 10 with a valve plate 20 being interposed therebetween.

A crank chamber 86 is provided within the front housing 16 such that one end of a drive shaft 44 is rotatably supported near the center of the front housing 16 and an opposite end of the drive shaft 44 passes through the crank chamber 86 to be supported by a bearing installed in a cylinder block 10.

A lug plate 54 and a swash plate 50 are installed around the drive shaft 44 within the crank chamber 86.

A pair of power transmitting support arms 62 each having a guide hole 64 linearly punched at the center thereof integrally protrude from one surface of the lug plate 54 and a ball 66 is formed on one surface of the swash plate 50 such that as the lug plate 54 rotates, the ball 66 of the swash plate 50 slides in the guide hole 64 of the lug plate 54, making it possible to vary an inclination angle of the swash plate 50.

Shoes 76 are mounted on an outer peripheral surface of the swash plate 50 such that they are slidably mounted to pistons 14.

Thus, as the swash plate 50 rotates while inclined, the pistons 14 to which the shoes 76 are mounted reciprocate within the cylinder bores 12 of the cylinder block 10.

A suction chamber 22 and a discharge chamber 24 are formed in the rear housing 18, and a suction opening 32 and a discharge opening 36 are formed at locations, corresponding to the cylinder bores 12, in a valve plate 20 interposed between the rear housing 18 and the cylinder block 10.

As the piston 14 reciprocates, a refrigerant within the suction chamber 22 is suctioned into the cylinder bores 12, compressed, and discharged into the discharge chamber 24, an inclination angle of the swash plate 50 varies due to a difference between a pressure in the crank chamber 86 and a pressure in the suction chamber 22, making it possible to regulate an amount of discharged refrigerant.

The variable displacement compressor employed in the embodiments of the present invention employs an electronic solenoid type displacement control valve 100 to open and close the valve when a current flows, making it possible to adjust a pressure in the crank chamber 86 and thus adjust an inclination angle of the swash plate 50 to regulate an amount of discharged refrigerant.

Hereinafter, displacement control valves of some embodiments of the present invention which can be employed in a variable displacement compressor of the present invention will be described.

Embodiment 1

Figure 3:
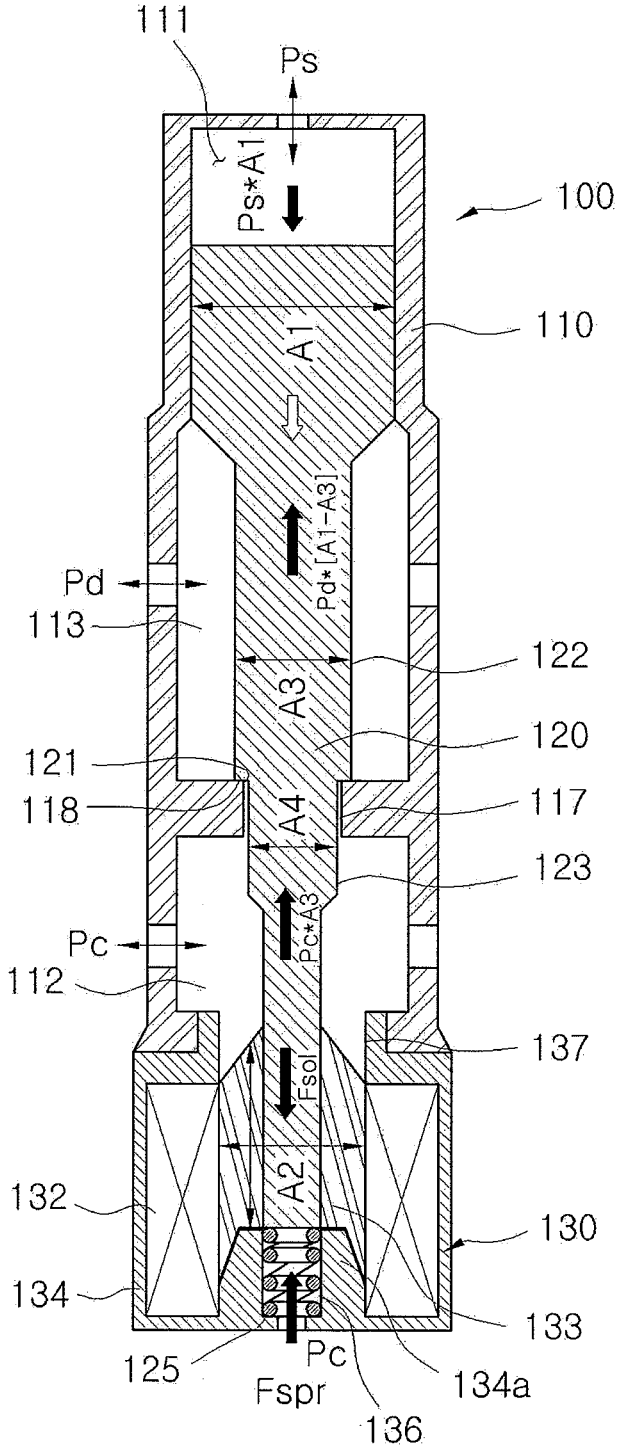
FIG. 3 is a longitudinal sectional view illustrating a closed structure of a displacement control valve according to the first embodiment of the present invention.
Figure 4:
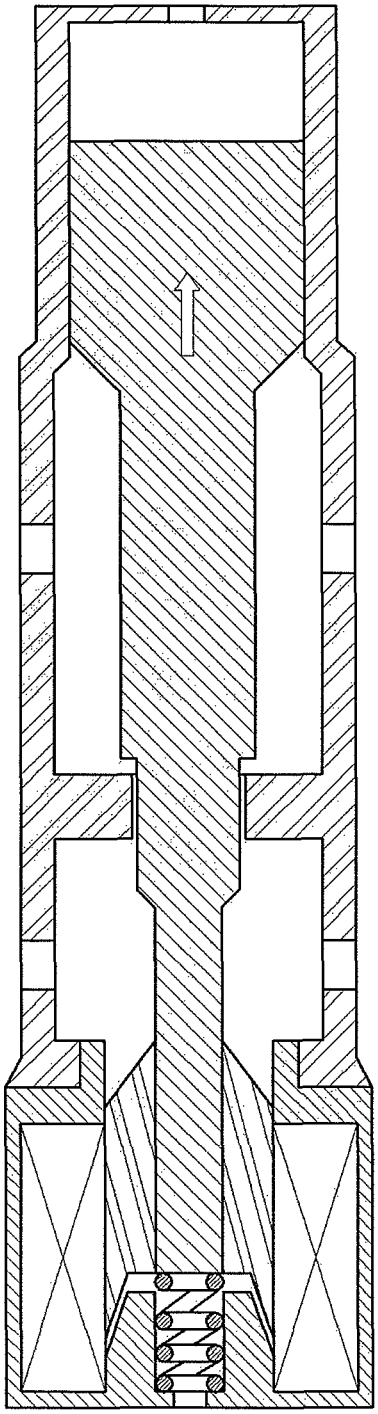
FIG. 4 is a longitudinal sectional view illustrating an opened structure of the displacement control valve according to the first embodiment of the present invention.

FIGS. 3 and 4 illustrates a displacement control valve 100 according to the embodiment of the present invention.

As illustrated in FIGS. 3 and 4, the displacement control valve 100 according to the embodiment of the present invention includes a valve housing 110 having several connecting holes, an electronic solenoid 130, a valve body 120 movably installed inside the valve housing 110 and the electronic solenoid 130.

A first guide hole 117 for guiding movement of the valve body 120 is formed in the valve housing 110, and a second hole 137 for guiding movement of a movable core 133 to be described later are formed in the electronic solenoid 130.

As a current flows through the electronic solenoid 130, the valve body 120 reciprocates to open and close the first guide hole 117 formed in the valve housing 110.

A suction chamber connecting space 111, a crank chamber connecting space 112, and a discharge chamber connecting space 113 to which a pressure Ps in the suction chamber 22, a pressure Pc in the crank chamber 86, and a pressure Pd in the discharge chamber 24 are applied respectively are formed in the valve housing 110. The discharge chamber connecting space 113 and the crank chamber connecting space 112 are communicated with each other through the first guide hole 117.

The suction pressure Ps is applied to a tip end of the valve body 120 through the suction chamber connecting space 111, and the area A1 of the valve body 120 is formed rather large.

The valve body 120 is divided into a large diameter portion 122 and a small diameter portion 123 with respect to a step 121.

In more detail, the small diameter portion 123 is formed on the side of the step 121 where the electronic solenoid 130 is situated, and the large diameter portion 122 is formed on the opposite side. The step 121 is configured to open and close an inlet of the first guide hole 117 connecting the discharge chamber connecting space 113 and the crank chamber connecting space 112.

According to the configuration, a seat surface 118 is formed to be closed as the valve body 120 goes from the discharge chamber connecting space 113 toward the crank chamber connecting space 112.

In particular, as illustrated in FIG. 3, since an area to which the discharge pressure Pd is applied is not determined not by a cross-sectional area A3 of the large diameter portion 122 but by a difference between the cross-sectional areas A1 and A3, even if the cross-sectional area A3 of the large diameter portion 122 of the valve body 120 is large, an over-current does not flow through the electronic solenoid 130, making it possible to prevent the electronic solenoid 130 from being overheated.

Meanwhile, the electronic solenoid 130 includes a movable core 133 connected to the valve body 120, a fixed core 134*a* disposed opposite to the movable core 133 along a feeding direction thereof, an electronic coil 132 disposed around the movable core 133, and a solenoid housing 134 surrounding the electronic coil 132.

The solenoid housing 134 may be formed of an injection-molded material surrounding the electronic coil 132.

Accordingly, when the movable core 133 and the valve body 120 reciprocate as a current flows through the electronic solenoid 130, an inlet of the first guide hole 117 connecting the discharge chamber connecting space 113 and the crank chamber connecting space 112 is opened and closed by the step 121 of the valve body 120.

An off-spring 125 is installed between the solenoid housing 134 and the movable core 133 or the valve body 120 to maintain the inlet of the first guide hole 117 in an opened state when the valve body 120 is lifted normally without any external force.

As illustrated in FIGS. 3 and 4, a solenoid pressure accommodating portion 136 is formed within the electronic solenoid 130.

In this case, the crank chamber pressure Pc is applied to the solenoid pressure accommodating portion 136. For this purpose, a separate connecting hole 116 is formed in the solenoid pressure accommodating portion 136 to be communicated with the crank chamber.

The cross-sectional area of the movable core 133 is indicted by A2, and a force obtained by multiplying the pressure Pc of the solenoid pressure accommodating portion 136 and the cross-sectional area A2 is applied to the movable core 133.

Figure 5:
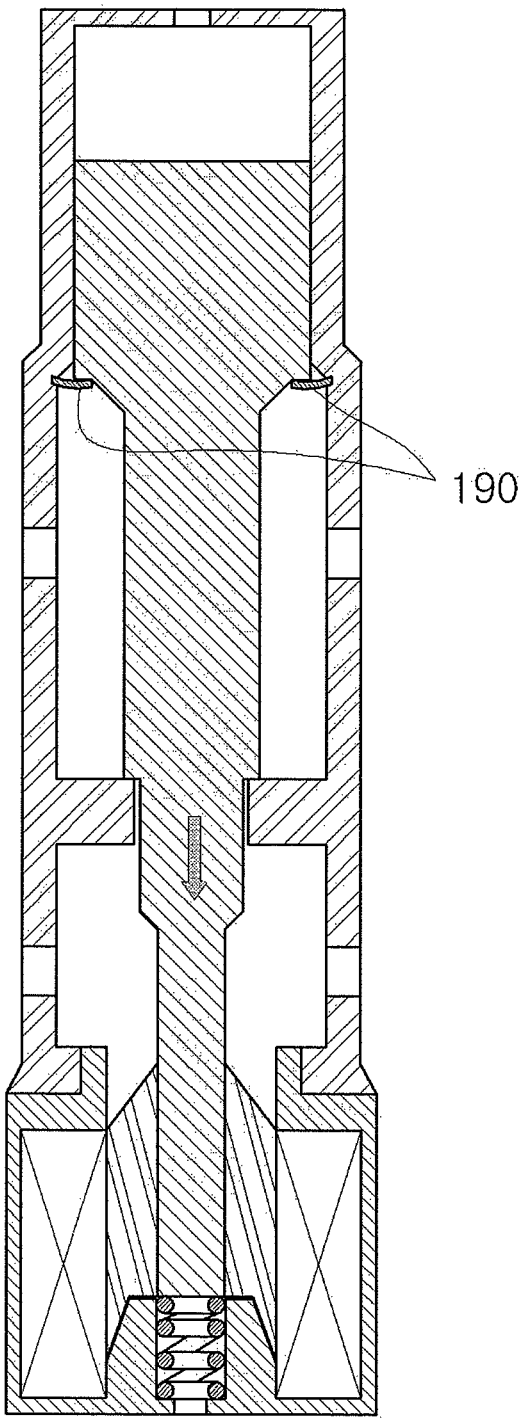
FIG. 5 is a longitudinal sectional view illustrating an closed structure of a modified example of the displacement control valve according to the first embodiment of the present invention.
Figure 6:
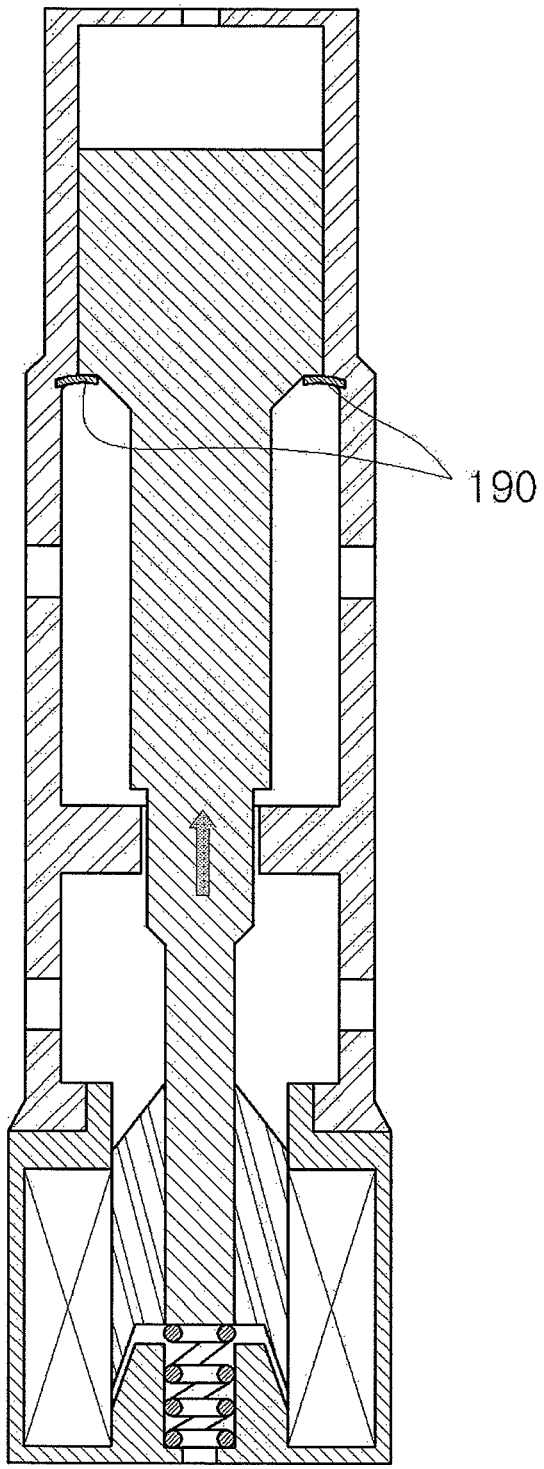
FIG. 6 is a longitudinal sectional view illustrating an opened structure of a modified example of the displacement control valve according to the first embodiment of the present invention.

As illustrated in FIGS. 5 and 6, a thermally deformed means such as a bimetal 190 is interposed between the valve housing 110 and the valve body 120 such that when a discharge temperature Td increases above a preset value, a force is applied in a direction in which the valve body 120 is opened, making it possible to lower the discharge temperature and thus preventing damage to the compressor.

Hereinafter, the operation of a displacement control valve according to the first embodiment of the present invention will be described with reference to FIGS. 3 and 4.

The initial state illustrated in FIG. 3 is a state where supply of power to the displacement control valve 100 is interrupted, in which case the valve body 120 is lifted by the off-spring 125 such that the step 121 of the valve body 120 is separated from the inlet of the first guide hole 117 connecting the discharge chamber connecting space 113 and the crank chamber connecting space 112 so as to be opened.

Accordingly, since the discharge pressure Pd is transmitted to the crank chamber connecting space 112 through the discharge chamber connecting space 113 via the first guide hole 117 to be applied to the crank chamber 86, the pressure in the crank chamber 86 increases, causing the inclination angle of the swash plate 50 to be reduced rapidly and an amount of discharged refrigerant to be reduced.

Next, an RPM of an engine, a difference between temperatures of indoor and outdoor units, and a temperature and a pressure downstream of an evaporator are detected. Then, signals related to the detected values are sent to an MCU, they are compared with a thermal load set in the MCU. If the detected thermal load exceeds a preset value, a current signal for increasing an amount of discharged refrigerant is sent to a power source.

Accordingly, an increased current flows through the electronic solenoid 130, and as illustrated in FIG. 4, the movable core 133 and the valve body 120 overcome a resisting force of the off-spring 125 and the discharge pressure Pd in the discharge chamber connecting space 113 to be lowered, closing the discharge chamber connecting space 113.

Accordingly, a pressure in the crank chamber 86 is rapidly reduced and an inclination angle of the swash plate 50 is rapidly increased, causing the discharge amount and discharge pressure of the compressor to be increased.

Also, a reduced pressure Pc is applied to the solenoid pressure accommodating portion 136, helping the electronic solenoid 130 lower the valve body 120.

Meanwhile, if the thermal load is reduced, a signal of a low current is transmitted from the MCU to the electronic solenoid 130, in which case an electromagnetic force is reduced such that a force is applied to the valve body 120 to lift the valve body 120 by the discharge pressure Pd and the off-spring 125.

Accordingly, the step 121 of the valve body 120 starts to be separated from the inlet of the first guide hole 117 connecting the discharge chamber connecting space 113 and the crank chamber connecting space 112. Thus, since the discharge pressure Pd is applied to the crank chamber 86, a pressure in the crank chamber 86 increases, causing the inclination angle of the swash plate 50 to be reduced rapidly and an amount of discharged refrigerant to be reduced.

An increased pressure Pc is applied to the solenoid pressure accommodating portion 136 in this state, helping the electronic solenoid 130 lift the valve body 120.

As illustrated in FIG. 3, an equilibrium relation between the elements in the displacement control valve of the present invention is as follows.

$$Fsol-Fspr-Pd\times(A1-A3)+Pc\times A3-Ps\times A1=(Pd-Ps)\times A1-(Pd-Pc)\times A3 \quad \text{Equation 1}$$

where A1 is a pressure area of the valve body from the suction chamber connecting space 111, A2 is a pressure area of the movable core 133 facing the solenoid pressure accommodating portion 136, A3 is a cross-sectional area of the large diameter portion 122 of the valve body 120, Fsol is an electromagnetic force of the electronic solenoid valve, and Fspr is a resilient force of the off-spring.

As described above, according to the displacement control valve of the embodiment of the present invention, an electromagnetic force of the electronic solenoid 130 and a force of the off-spring 125 maintain an equilibrium state of a force due to a difference between the discharge pressure Pd and the suction pressure Ps and a difference between the discharge pressure Pd and the crank chamber pressure Pc to regulate an opening degree of the valve.

Although it has been described that the step 121 of the valve body 120 opens and closes the inlet of the first guide hole 117, it is apparent that an opening degree of the guide hole 117 can be regulated according to an amount of flowing current.

Embodiment 2

Figure 7:
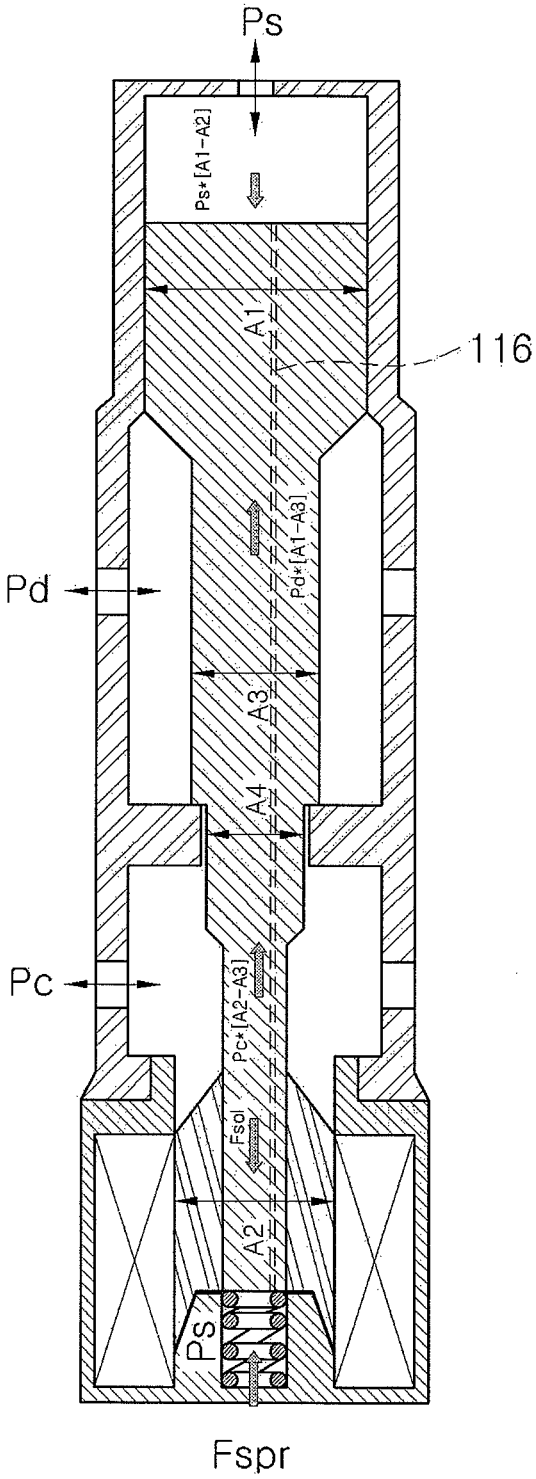
FIG. 7 is a longitudinal sectional view illustrating an opened structure of a displacement control valve according to the second embodiment of the present invention.

FIG. 7 illustrates a displacement control valve 100 according to the embodiment of the present invention. In the description of the specification, the same elements as in the first embodiment will be endowed with the same reference numerals, and will be omitted in the drawing.

The displacement control valve 100 according to the embodiment of the present invention is the same as the first embodiment of the present invention except that a suction pressure Ps is applied to the solenoid pressure accommodating portion 136, and a detailed description thereof will be omitted.

In this case, in order that the suction pressure Ps can be applied to the solenoid pressure accommodating portion 136, an introduction opening (not shown) communicating the suction chamber 22 and the solenoid pressure accommodating portion 136 may be formed in the compressor housing 18 and the solenoid housing 134 or a connecting passage 129 may be formed to connect a space to which the suction pressure Ps is applied and which is formed by the suction chamber connecting space 111 and a tip end of the valve body 120 and the solenoid pressure accommodating portion 136 within the displacement control valve 100.

As illustrated in FIG. 7, an equilibrium relation of a force between elements in the displacement control valve according to the second embodiment of the present invention is as follows.

$$Fsol-Fspr=Pd\times(A1-A3)-Pc\times(A2-A3)-Ps\times(A1-A2)=(Pd-Ps)\times A1-(Pc-Ps)\times A2-(Pd-Pc)\times A3 \quad \text{Equation 2}$$

where A1 is a pressure area of the valve body from the suction chamber connecting space 111, A2 is a pressure area of the movable core 133 facing the solenoid pressure accommodating portion 136, A3 is a cross-sectional area of the large diameter portion 122 of the valve body 120, Fsol is an electromagnetic force of the electronic solenoid, and Fspr is a resilient force of the off-spring.

As described above, in the displacement control valve according to the embodiment of the present invention, an electromagnetic force of the solenoid 130 and a force of the off spring 125 maintain an equilibrium state of a force due to a difference between the discharge pressure Pd and the suction pressure Ps, a difference between the discharge pressure Pd and the crank chamber pressure Pc, and a difference between the crank chamber pressure Pc and the suction pressure Ps such that the opening degree of the valve is controlled.

Although it has been described that the step 121 of the valve body 120 opens and closes the inlet of the first guide hole 117, it is apparent that an opening degree of the guide hole 117 can be regulated according to an amount of flowing current.

Embodiment 3

Figure 8:
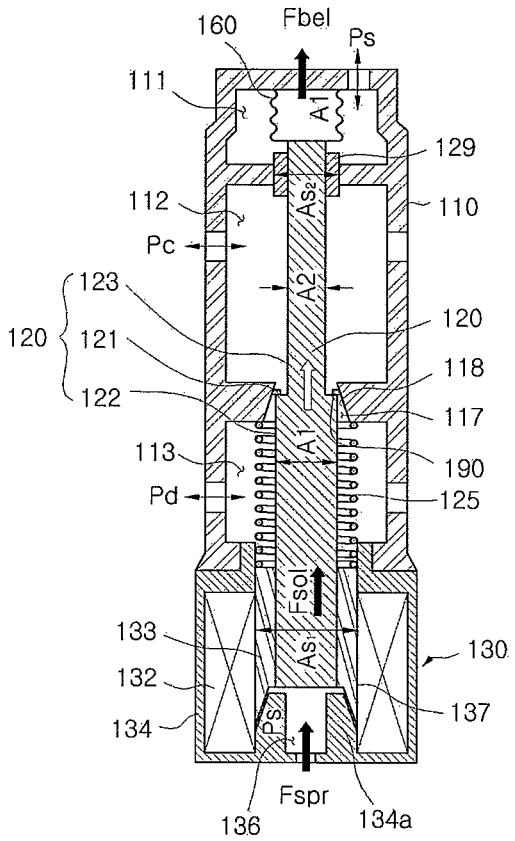
FIG. 8 is a longitudinal sectional view illustrating a closed structure of a displacement control valve according to the third embodiment of the present invention.
Figure 9:
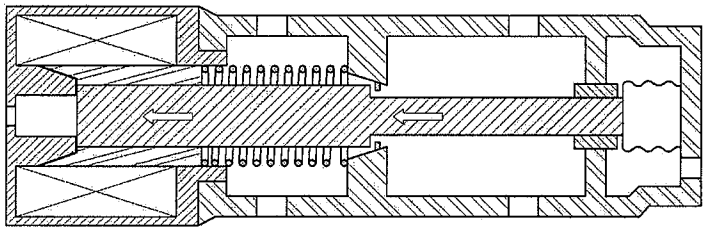
FIG. 9 is a longitudinal sectional view illustrating an opened structure of the displacement control valve according to the third embodiment of the present invention.

FIGS. 8 and 9 illustrate a displacement control valve 100 according to the embodiment of the present invention.

As illustrated in FIGS. 8 and 9, the displacement control valve 100 according to the embodiment of the present invention includes a valve housing 110 having several connecting holes, an electronic solenoid 130, and a valve body 120 movably installed inside the valve housing 110 and the electronic solenoid 130.

A first guide hole 117 for guiding movement of the valve body 120 is formed in the valve housing 110, and a second hole 137 for guiding movement of a movable core 133 to be described later are formed in the electronic solenoid 130.

As a current flows through the electronic solenoid 130, the valve body 120 reciprocates to open and close the first guide hole 117 formed in the valve housing 110.

A suction chamber connecting space 111, a crank chamber connecting space 112, and a discharge chamber connecting space 113 to which a pressure Ps in the suction chamber 22, a pressure Pc in the crank chamber 86, and a pressure Pd in the discharge chamber 24 are applied respectively are formed in the valve housing 110. The discharge chamber connecting space 113 and the crank chamber connecting space 112 are communicated with each other through the first guide hole 117.

The suction pressure Ps is applied to a tip end of the valve body 120 through the suction chamber connecting space 111.

A bellows 160 is installed at a tip end of the valve body 120.

The bellows 160 is a wrinkled structure configured to apply a force to another element connected to it while being expanded and contracted by an external pressure.

The valve body 120 is divided into a large diameter portion 122 and a small diameter portion 123 with respect to a step 121. The large diameter portion 122 is formed on the side of the step 121 where the electronic solenoid 130 is situated, and the small diameter portion 123 is formed on the opposite side. The step 121 is configured to open and close an inlet of the first guide hole 117 connecting the discharge chamber connecting space 113 and the crank chamber connecting space 112.

According to the configuration, a seat surface 118 is formed to be closed as the valve body 120 goes from the discharge chamber connecting space 113 toward the crank chamber connecting space 112.

In particular, as illustrated in FIG. 8, since an area to which the discharge pressure Pd is applied is not determined not by a cross-sectional area A1 of the large diameter portion 122 but by a difference between the cross-sectional areas As1 and A3, even if the cross-sectional area A1 of the large diameter portion 122 of the valve body 120 is large, an over-current does not flow through the electronic solenoid 130, making it possible to prevent the electronic solenoid 130 from being overheated.

That is, since the discharge pressure Pd is applied not directly to a cross-section of the valve body 120 but to a difference As1−A1 between cross-sectional areas of adjacent portions, if the difference in the areas is reduced, the magnitude of the force by the pressure Pd becomes smaller, making it possible to make a cross-sectional area of the valve body 120 large.

A pressure portion 129 to which the suction pressure Ps at an opposite tip end of the electronic solenoid of the valve body 120 and the crank chamber pressure Pc are simultaneously applied is installed at the small diameter portion 123 of the valve body 120, and a cross-section of a portion, out of the pressure portion 129, to which the crank chamber pressure Pc is applied is the same as that of the large diameter portion 122 of the valve body 120, making it possible to reduce an influence of the pressure Pc of the crank chamber in opening and closing the valve.

The reference numeral A2 which has not been described is a cross-sectional area of the small diameter portion 123, and a section of the cross-sectional area A2 in the embodiment only refers to a connecting portion.

Meanwhile, the electronic solenoid 130 includes a movable core 133 connected to the valve body 120, a fixed core 134*a* disposed opposite to the movable core 133 along a feeding direction thereof, an electronic coil 132 disposed around the movable core 133, and a solenoid housing 134 surrounding the electronic coil 132.

The solenoid housing 134 may be formed of an injection-molded material surrounding the electronic coil 132.

Accordingly, when the movable core 133 and the valve body 120 reciprocate as a current flows through the electronic solenoid 130, an inlet of the first guide hole 117 connecting the discharge chamber connecting space 113 and the crank chamber connecting space 112 is opened and closed by the step 121 of the valve body 120.

An off-spring 125 is connected to the movable core 133 or the valve body 120 to maintain the inlet of the first guide hole 117 in an opened state when the valve body 120 is lowered normally without any external force.

As illustrated in FIGS. 8 and 9, a solenoid pressure accommodating portion 136 is formed within the movable core 133 and the solenoid housing 134.

In order that the suction pressure Ps can be applied to the solenoid pressure accommodating portion 136, an introduction opening (not shown) communicating the suction chamber 22 and the solenoid pressure accommodating portion 136 may be formed in the compressor housing 18 and the solenoid housing 134 or a connecting passage may be formed to connect a space to which a pressure Ps is applied and which is formed by the suction chamber connecting space 111 and a tip end of the valve body 120 and the solenoid pressure accommodating portion 136 within the displacement control valve 100.

The cross-sectional area of the movable core 133 is indicted by As1, and a force obtained by multiplying the pressure Ps of the solenoid pressure accommodating portion 136 and the cross-sectional area As1 is applied to the movable core 133.

As illustrated in FIGS. 8 and 9, a thermally deformed means such as a bimetal 190 is interposed between the valve housing 110 and the valve body 120 such that when a discharge temperature Td increases above a preset value, a force is applied in a direction in which the valve body 120 is opened, making it possible to lower the discharge temperature and thus preventing damage to the compressor.

Hereinafter, the operation of a displacement control valve according to the third embodiment of the present invention will be described with reference to FIGS. 8 and 9.

The initial state illustrated in FIG. 8 is a state where supply of power to the displacement control valve 100 is interrupted, in which case the valve body 120 is lowered by the off-spring 125 such that the step 121 of the valve body 120 is separated from the inlet of the first guide hole 117 connecting the discharge chamber connecting space 113 and the crank chamber connecting space 112 so as to be opened.

Accordingly, since the discharge pressure Pd is transmitted to the crank chamber connecting space 112 through the discharge chamber connecting space 113 via the first guide hole 117 to be applied to the crank chamber 86, the pressure in the crank chamber 86 increases, causing the inclination angle of the swash plate 50 to be reduced rapidly and an amount of discharged refrigerant to be reduced.

Next, an RPM of an engine, a difference between temperatures of indoor and outdoor units, and a temperature and a pressure downstream of an evaporator are detected. Then, signals related to the detected values are sent to an MCU, they are compared with a thermal load set in the MCU. If the detected thermal load exceeds a preset value, a current signal for increasing an amount of discharged refrigerant is sent to a power source.

Accordingly, an increased current flows through the electronic solenoid 130, and as illustrated in FIG. 4, the movable core 133 and the valve body 120 overcome a resisting force of the off-spring 125 and the discharge pressure Pd in the discharge chamber connecting space 113 to be lifted, closing the discharge chamber connecting space 113.

Accordingly, since a pressure in the crank chamber 86 is reduced rapidly and an inclination angle of the swash plate 50 increases rapidly, an amount of discharged refrigerant and a discharge pressure of the compressor increase.

Then, as an external thermal load, i.e. a temperature of the interior of the compressor increases, a suction pressure Ps also increases. The increased suction pressure Ps applied to the suction pressure connecting space 111 via a filter 162.

The bellows 160 is contracted by the increased suction pressure Ps, and an increased force is applied to the valve body 120 fixed to the bellows 160. In this connection, even if a current applied to the electronic solenoid 130 is low, the valve body 120 can be easily lifted. If an amount of currents applied to the electronic solenoid 130 becomes smaller, an amount of heat from the electronic coil 132 also decreases, making it possible to reduce a thermal influence of the electronic solenoid 130 and maintaining reliability.

Meanwhile, if the thermal load is reduced, a signal of a low current is transmitted from the MCU to the electronic solenoid 130, in which case an electromagnetic force is reduced such that a force is applied to the valve body 120 to lower the valve body 120 by the discharge pressure Pd and the off-spring 125.

Accordingly, the step 121 of the valve body 120 starts to be separated from the inlet of the first guide hole 117 connecting the discharge chamber connecting space 113 and the crank chamber connecting space 112. Thus, since the discharge pressure Pd is applied to the crank chamber 86, a pressure in the crank chamber 86 increases, causing the inclination angle of the swash plate 50 to be reduced rapidly and an amount of discharged refrigerant to be reduced.

This state is a state where the interior of the compressor is sufficiently cooled, in which case the suction pressure Ps is naturally reduced and the bellows 160 is expanded again, helping lower the valve body 120.

As illustrated in FIG. 7, an equilibrium relation between the elements in the displacement control valve of the present invention is as follows.

$$Fsol+Fbel-Fspr=(Pd-Ps)\times(As1-As2) \quad \text{Equation 3}$$

where As1 is a cross-sectional area of the large diameter portion 122, As2 is a cross-sectional area of a tip end of the valve body 120 protruding from the suction pressure connecting space 111, Fsol is an electromagnetic force of the electronic solenoid valve, Fbel is a force applied to the valve body 120 by the bellows, and Fspr is a resilient force of the off-spring.

As described above, an electromagnetic force of the electronic solenoid 130 and a force of the bellows 160 are proportional to the discharge pressure Pd and the suction pressure Ps. That is, from a magnitude of current applied to the electronic solenoid 130 a difference Pd−Ps between the discharge pressure and the suction pressure, and a torque and a discharge capacity due to the pressure difference can be easily regulated.

Although it has been illustrated that the step 121 of the valve body 120 opens and closes an inlet of the first guide hole 117, an opening degree of the guide hole 117 can be regulated according to an amount of flowing current.

INDUSTRIAL APPLICABILITY

According to the present invention, a position of the seat surface is changed such that the seat surface is closed as the valve body goes from the discharge chamber connecting space toward the crank chamber connecting space, making it possible to enlarge a cross-sectional area of the valve body and improving productivity.

According to the present invention, a valve can be compulsorily opened when a discharge temperature is excessively high, avoiding damage to the peripheral structure of a compressor.

The invention claimed is:

1. A displacement control valve for a variable displacement compressor comprising:

a valve housing having a discharge chamber connecting space and a crank chamber connecting space, the discharge chamber connecting space being in fluid communication with a discharge chamber of the variable displacement compressor, the crank chamber connecting space being in fluid communication with a crank chamber of the variable displacement compressor, wherein the valve housing comprises a hole providing a fluid communication channel between the discharge chamber connecting space and the crank chamber connecting space;

a valve body configured to reciprocate within the valve housing to open and close the fluid communication channel, wherein the valve body comprises a large diameter portion and a small diameter portion having a diameter smaller than that of the large diameter portion, the small diameter portion being inserted in the hole, wherein the valve body further comprises a valve seat disposed between the large diameter portion and the small diameter portion and configured to open and close the fluid communication channel, wherein the valve body is biased by a spring to open the fluid communication channel, wherein the valve body comprises a first end to which a suction pressure is applied and a second end to which a crank chamber pressure is applied, the second end being coupled to the solenoid;

a solenoid configured to move the valve body; and a thermally deformable means installed in the discharge chamber connecting space of the valve housing and coupled to the valve housing and the valve body such that deformation of the thermally deformable means causes the valve body to open or close the fluid communication channel.

2. The displacement control valve as claimed in claim 1, wherein a first guide hole connecting the discharge chamber connecting space and the crank chamber connecting space passes through the interior of the valve housing, wherein the valve body is divided into a large diameter portion and a small diameter portion with respect to a step configured to open and close an inlet of the first guide hole, wherein the valve body is supported by an off-spring, and wherein a suction pressure is applied to a tip end of the valve body opposite to the electronic solenoid and an end of the valve body on the side of the electronic solenoid respectively.

3. The displacement control valve as claimed in claim 1, wherein a first guide hole connecting the discharge chamber connecting space and the crank chamber connecting space passes through the interior of the valve housing, wherein the valve body is divided into a large diameter portion and a small diameter portion with respect to a step configured to open and close an inlet of the first guide hole, wherein the valve body is supported by an off-spring, wherein a suction pressure is applied to a tip end of the valve body opposite to the electronic solenoid and an end of the valve body on the side of the electronic solenoid respectively, and wherein a bellows is installed at a tip end of the valve body opposite to the electronic solenoid.

4. The displacement control valve as claimed in claim 3, wherein a connecting passage is formed between the tip end of the valve body opposite to the electronic solenoid and the end of the valve body on the side of the electronic solenoid, to which the suction pressure is applied.

5. The displacement control valve as claimed in claim 4, wherein a pressure portion to which the suction pressure at the tip end of the valve body opposite to the electronic solenoid and the crank chamber pressure are simultaneously applied is installed at the small diameter portion of the valve body, and wherein a cross-sectional area of a portion, out of the pressure portion, to which the crank chamber pressure is applied is the same as a cross-sectional area of the large diameter portion of the valve body.

6. The displacement control valve as claimed in claim 5, wherein the pressure portion is detachably installed in the valve body.

7. The displacement control valve as claimed in claim 5, wherein a connecting passage is formed between the tip end of the valve body opposite to the electronic solenoid and the end of the valve body on the side of the electronic solenoid, to which the suction pressure is applied.

8. The displacement control valve as claimed in claim 1, wherein the thermally deformable means is a bimetal.

9. A displacement control valve for a variable displacement compressor comprising:

a valve housing having a discharge chamber connecting space and a crank chamber connecting space, the discharge chamber connecting space being in fluid communication with a discharge chamber of the variable displacement compressor, the crank chamber connecting space being in fluid communication with a crank chamber of the variable displacement compressor;

a valve body configured to reciprocate within the valve housing to open and close a fluid communication channel between the crank chamber connecting space and the discharge chamber connecting space;

a solenoid configured to move the valve body; and a thermally deformable means installed in the discharge chamber connecting space of the valve housing and cow led to the valve housing and the valve body such that deformation of the thermally deformable means causes the valve body to open or close the fluid communication channel.

10. The displacement control valve as claimed in claim 9, wherein the thermally deformable means is a bimetal.

* * * * *

UNITED STATES PATENT AND TRADEMARK OFFICE

CERTIFICATE OF CORRECTION

PATENT NO. : 9,022,061 B2
APPLICATION NO. : 13/123492
DATED : May 5, 2015
INVENTOR(S) : Hak Soo Kim

It is certified that error appears in the above-identified patent and that said Letters Patent is hereby corrected as shown below:

On the title page, item (57) in Abstract at line 5, change “housing” to --housing using--.

In the Specification:

In column 2 at line 60, change “housing” to --housing using--.

In column 2 at line 65, change “space” to --space.--.

In column 3 at line 54, change “housing” to --housing using--.

In the Claims:

In column 14 at lines 14-15, in Claim 9, change “cow led” to --coupled--.

Signed and Sealed this
Twelfth Day of April, 2016

Michelle K. Lee

Michelle K. Lee
*Director of the United States Patent and Trademark Office*